US010166564B2

(12) United States Patent
Pouliaude et al.

(10) Patent No.: US 10,166,564 B2
(45) Date of Patent: Jan. 1, 2019

(54) FLUID PRODUCT DISPENSER WITH CAPTIVE PUSHER

(71) Applicant: APTAR FRANCE SAS, Le Neubourg (FR)

(72) Inventors: Florent Pouliaude, Fouqueville (FR); Yannick Pointel, Epegard (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 15/521,972

(22) PCT Filed: Oct. 23, 2015

(86) PCT No.: PCT/FR2015/052852

§ 371 (c)(1),
(2) Date: Apr. 26, 2017

(87) PCT Pub. No.: WO2016/066934

PCT Pub. Date: May 6, 2016

(65) Prior Publication Data

US 2017/0312771 A1 Nov. 2, 2017

(30) Foreign Application Priority Data

Oct. 27, 2014 (FR) ..... 14 60312

(51) Int. Cl.
*B05B 11/00* (2006.01)
*B65D 83/20* (2006.01)

(52) U.S. Cl.
CPC ..... *B05B 11/3052* (2013.01); *B05B 11/0037* (2013.01); *B05B 11/0054* (2013.01); *B65D 83/205* (2013.01)

(58) Field of Classification Search
CPC ..... B05B 11/0054; B05B 11/3059; B05B 11/306; B05B 11/3052; B05B 15/65;
(Continued)

(56) References Cited

U.S. PATENT DOCUMENTS 2,884,164 A * 4/1959 Kleid ..... B05B 11/3032 222/182
3,878,976 A * 4/1975 Giuffredi ..... B65D 83/205 222/402.13

(Continued)

FOREIGN PATENT DOCUMENTS

EP 1 266 845 A1 12/2002
FR 2 825 989 A1 12/2002

(Continued)

OTHER PUBLICATIONS

International Search Report of PCT/FR2015/052852 dated Feb. 4, 2016 [PCT/ISA/210].

(Continued)

*Primary Examiner* — Patrick M Buechner
(74) *Attorney, Agent, or Firm* — Sughrue Mion, PLLC

(57) ABSTRACT

A fluid dispenser having a fluid reservoir; a dispenser member mounted on the reservoir and that includes an actuator rod; a pusher mounted on the actuator rod; and a covering shell in which an assembly, formed by the reservoir and its dispenser member, is held in removable manner. The pusher is held captive by the covering shell, the pusher is axially movable in the covering shell over a limited stroke defined by a low abutment and a high abutment. A magnetic device acts between the covering shell and the pusher so as to hold the pusher, by magnetic attraction/repulsion, in a determined position that is stationary relative to the covering shell, when the actuator rod is disconnected from the pusher.

13 Claims, 2 Drawing Sheets

(58) Field of Classification Search
CPC ..... B65D 83/16; B65D 83/20; B65D 83/205; B65D 83/206
See application file for complete search history.

(56) References Cited

U.S. PATENT DOCUMENTS

| | | | | |
|---|---|---|---|---|
| 7,743,949 | B2 * | 6/2010 | Ramet | B05B 11/0051 141/23 |
| 9,718,072 | B2 * | 8/2017 | Bruder | B05B 11/0018 |
| 2012/0205401 | A1 * | 8/2012 | Litten | A45D 34/02 222/252 |
| 2014/0252043 | A1 | 9/2014 | Pouliaude | |
| 2017/0144812 | A1 * | 5/2017 | Duquet | A45D 34/045 |
| 2017/0361344 | A1 * | 12/2017 | Dutton | B05B 11/3052 |

FOREIGN PATENT DOCUMENTS

| | | | | |
|---|---|---|---|---|
| FR | 3030461 | A1 * | 6/2016 | A45D 34/00 |
| FR | 3037569 | A1 * | 12/2016 | B65D 45/02 |
| WO | 2014/108641 | A1 | 7/2014 | |

OTHER PUBLICATIONS

International Preliminary Report on Patentability and Translation of Written Opinion issued from the International Bureau in counterpart International Application No. PCT/FR2015/052852, dated May 11, 2017.

* cited by examiner

FLUID PRODUCT DISPENSER WITH CAPTIVE PUSHER

CROSS REFERENCE TO RELATED APPLICATIONS

This application is a National Stage of International Application No. PCT/FR2015/052852, filed Oct. 23, 2015, claiming priority based on French Patent Application No. 1460312, filed Oct. 27, 2014, the contents of all of which are incorporated herein by reference in their entirety.

The present invention relates to a fluid dispenser comprising: a fluid reservoir that defines an opening; a dispenser member that is mounted in the opening of the reservoir and that includes an actuator rod; a pusher for mounting on the actuator rod of the dispenser member; and a covering shell in which an assembly, formed by the reservoir and its dispenser member, is adapted to be held in removable manner, the pusher being held captive by the covering shell so that said actuator rod can be connected to the pusher only in the covering shell, the pusher being axially movable in the covering shell over a limited stroke that is defined by a low abutment and a high abutment. Advantageous fields of application of the present invention are the fields of perfumery, cosmetics, and pharmacy.

Prior-art document FR 2 825 989 describes a fluid dispenser of this type, including a pusher that is held captive by a covering shell so that the actuator rod of a dispenser member (pump or valve) can be connected to the pusher only in the covering shell. The dispenser member is mounted on or in the opening of a fluid reservoir so as to form an assembly that defines a refill. In addition, the pusher that is held captive by the covering shell constitutes another assembly that is adapted to receive the assembly constituted by the reservoir and by the dispenser member.

In that prior-art dispenser, the pusher is indeed held captive by the covering shell, but it can move inside the shell over a limited stroke that is defined by a low abutment and by a high abutment. Thus, when the refill formed by the reservoir and by its dispenser member is not in place inside the covering shell, the pusher is free to move over this limited stroke under the effect of gravity. As a result, the movement of the pusher inside the shell can generate undesirable noises. Worse still, the pusher could become blocked inside the shell in such a manner that the dispenser becomes unusable.

An object of the present invention is to remedy the above-mentioned drawbacks of the prior-art by defining a fluid dispenser having a captive pusher that is not free to move inside the covering shell. Another object of the present invention is for the captive pusher to be arranged inside the covering shell in a position that is determined when the refill is not in place inside the covering shell. Still another object of the present invention is to avoid using mechanical holding means or techniques, e.g. friction, screw-fastening, or snap-fastening, that might lead to blockages, hard points, or worse still to parts breaking.

To achieve these objects, the present invention proposes magnetic means that act between the covering shell and the pusher so as to hold the pusher, by magnetic attraction/repulsion, in a determined position that is stationary relative to the covering shell, when the actuator rod is disconnected from the pusher. Thus, the magnetic means generate magnetic attraction or repulsion holding the pusher stationary in a predetermined position inside the covering shell.

In a first embodiment of the invention, the magnetic means comprise at least one shell magnet that is secured to the covering shell, and at least one pusher magnet that is secured to the pusher. In this first embodiment, the two magnets attract or repel each other as a function of the arrangement and/or the orientation of the magnetic poles of the two magnets.

In a second embodiment of the invention, the magnetic means comprise at least one magnet that is secured to the covering shell or to the pusher, and at least one ferromagnetic element that is secured to the pusher or to the covering shell. In this situation, the ferromagnetic element is always attracted by the magnet: there are no phenomena of magnetic repulsion.

In a first advantageous aspect of the present invention, the magnetic means may hold the pusher in said determined position that corresponds to putting a stud that is secured to the pusher into abutment against one of the low and high abutments formed by the covering shell. In other words, the pusher is attracted or repelled against the high abutment or the low abutment of the covering shell.

Advantageously, the covering shell defines a holding collar in which the pusher is engaged and held captive while moving axially over said limited stroke. Preferably, the holding collar defines at least one axial guide groove that is closed at both of its ends, respectively defining the low and high abutments, the pusher including at least one stud that is engaged in the axial guide groove and that is axially movable in the axial guide groove between its low and high abutments, the stud advantageously being formed on a flexible tab that enables the stud to be put into place in the axial guide groove by elastically deforming the flexible tab. The pusher may thus be put into place in the holding collar with its stud(s) engaged in the axial guide groove(s) merely by axial thrust, by deforming the flexible tabs on which the studs are formed.

According to another advantageous characteristic of the invention, the shell includes a cylinder that surrounds the reservoir, the shell magnet or the ferromagnetic element being mounted on the cylinder.

In another advantageous aspect of the present invention, the pusher may include a connection sleeve for coming into engagement with the actuator rod, the pusher magnet or the ferromagnetic element that is secured to the pusher being mounted around the connection sleeve.

In a particular embodiment, the actuator rod may be provided with a rod magnet or with a rod ferromagnetic element that co-operates with the pusher magnet or with the pusher ferromagnetic element so as to make the magnetic connection between the actuator rod and the pusher. Advantageously, the magnetic attraction is stronger between the actuator rod and the pusher than between the pusher and the covering shell. Preferably, the magnetic means hold the pusher in said determined position that corresponds to being put into abutment against the low abutment. Thus, when the assembly formed by the reservoir and the dispenser member is put into the covering shell, the actuator rod that is provided with a magnet or with a ferromagnetic element quickly comes into contact with the connection sleeve, which is itself provided with a magnet or with a ferromagnetic element. The pusher is thus still in abutment against the low abutment. The user then pushes on the reservoir so as to move it into its final position in which the studs of the pusher come into the proximity of, or into abutment against, the high abutment. This means that the magnet or the ferromagnetic element of the pusher has been moved away from the magnet or the ferromagnetic element of the covering shell, such that the magnetic attraction or repulsion has decreased. In addition, depressing the pusher goes in the direction of increased magnetic attraction or repulsion with the covering shell, thereby making it possible, optionally in perceptible manner, to reduce the force needed to depress the pusher.

The spirit of the invention relies on using magnetic attraction or repulsion to prevent a pusher from moving inside a covering shell when the refill, formed by a dispenser member and by a reservoir, is not in place inside the covering shell. By holding the pusher stationary in this way, it is possible to avoid any unnecessary movement of the pusher inside the shell. Furthermore, the magnetic attraction or repulsion may be used to provide a refill that itself is provided with a magnet or with a ferromagnetic element capable of making a magnetic connection between the actuator rod of a pump or a valve and the pusher.

The invention is described below in greater detail with reference to the accompanying drawings, which show several embodiments of the invention as non-limiting examples.

The fluid dispenser of the present invention is made up of a first assembly constituted by a reservoir on which there is mounted a dispenser member such as a pump or a valve, and of a second assembly, or sub-assembly, constituted by, or comprising, a covering shell 4 and a pusher 3. The first assembly, or sub-assembly, is received in removable manner inside the covering shell 4 of the second assembly, and thus constitutes a refill that may be removed so as to be replaced by another.

Figure 1:
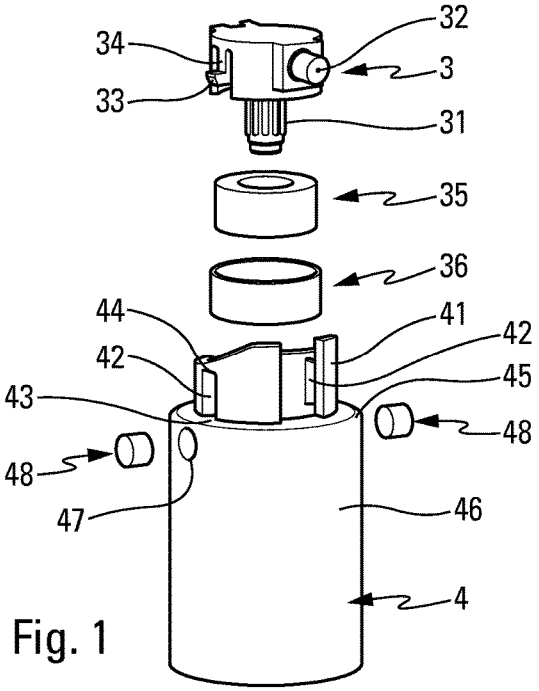
FIG. 1 is an exploded perspective view of an assembly formed by a pusher and a covering shell in a first embodiment of the invention.
Figure 2:
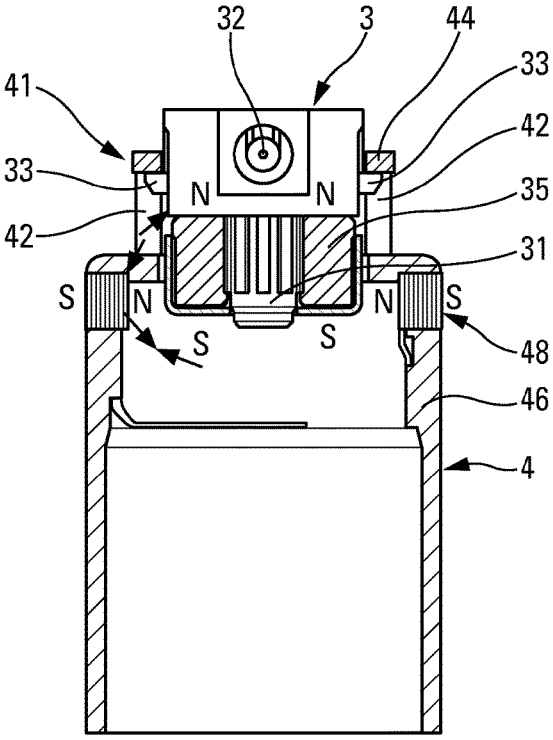
FIG. 2 is a vertical section view of the FIG. 1 assembly in its assembled state.

Reference is made firstly to FIGS. 1 and 2 in order to describe in detail the structure of a second assembly constituting a first embodiment of the present invention. The second assembly thus comprises a covering shell 4 and a pusher 3 that is received inside the shell 4 in such a manner as to held captive therein. In FIG. 1, it can be seen that the covering shell 4 includes a holding collar 41 at its top portion. The holding collar 41 defines two axial guide grooves 42 that are arranged in diametrally-opposite manner in this embodiment. Without going beyond the ambit of the invention, the holding collar 41 may define a single axial guide groove, or, on the contrary, more than two axial guide grooves. The axial guide grooves 42 extend vertically or axially in such a manner as to define two ends that form a low abutment 43 and a high abutment 44. The low abutment 43 may be formed by a shoulder 45 from which the covering shell 4 defines a cylinder 46 that is wide open at its bottom end. In the proximity of the shoulder 43, the cylinder 46 defines two housings 47 in which two permanent magnets 48 are received. In this embodiment, the magnets 48 are in the form of substantially cylindrical lugs with the north pole directed towards the inside of the shell and the south pole directed towards the outside of the shell, as can be seen in FIG. 2. It can thus be said that the magnets 48 are arranged axially below the axial guide grooves 42 and are separated by the shoulder 45 that forms the low abutment 43 of the grooves 42. It should also be observed that the diameter of the holding collar 41 is less than the diameter of the cylinder 46.

The pusher 3 includes a connection sleeve 31 that extends axially downwards. The inside of the sleeve 31 defines a fluid feed channel that extends as far as a dispenser orifice 32 that is formed sideways in this embodiment. It should also be observed that the pusher 3 includes two flexible tabs 34 that are arranged in diametrally-opposite manner. A stud 33 that projects radially outwards is formed at the free end of each flexible tab 34. Thus, the stud 33 is suitable for being moved radially inwards by elastically deforming the flexible tab 34. The pusher 3 also includes a pusher magnet 35 that is engaged around the connection sleeve 31. By way of example, the pusher magnet 35 may present an annular cylindrical shape and be engaged around the sleeve 31 by clamping so as to fasten it. The pusher 35 may be covered or masked by a hoop 36 that may optionally be made of ferromagnetic material.

As can be seen in FIG. 2, the pusher 3 is engaged inside the holding collar 41, such that the two studs 33 are received inside the axial guide grooves 42. The studs 33 can be received in the respective grooves 42 by means of the flexible tabs 34 elastically deforming, enabling the studs 33 to pass inside the high abutments 44 of the holding collar 41. Once the studs 33 are engaged inside the grooves 42, the pusher 3 is prevented from turning, but can move axially over a limited stroke that is defined between the low abutments 43 and the high abutments 44 of the two axial guide grooves 42. In FIG. 2, it can be seen that the two studs 33 are in contact with, or in abutment against, the high abutments 44. This results from the pusher magnet 35 presenting a downwardly-directed south pole and an upwardly-directed north pole. Thus, the shell magnet 48 and the pusher magnet 35 repel each other in such a manner as to move the pusher upwards until the studs 33 advantageously come into abutment against the high abutments 44. The pusher 3 is thus held stationary or in a determined position relative to the covering shell 4. The axial grooves 42 prevent turning, and the magnetic repulsion forces that are generated by the magnetic means 35, 48 hold the pusher 3 axially.

Figure 3:
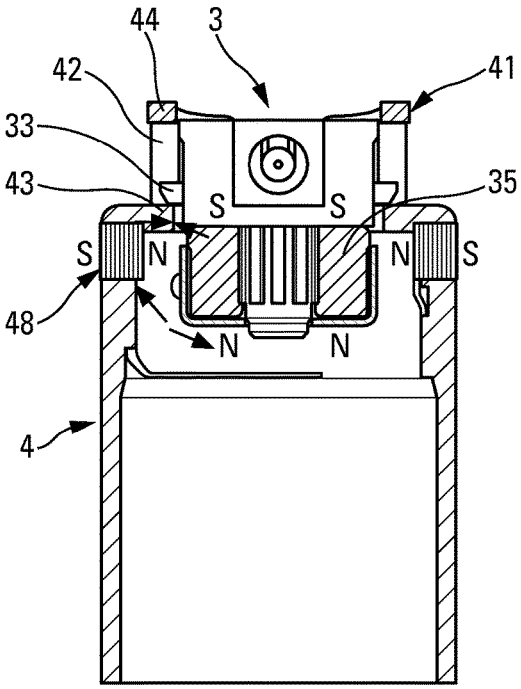
FIG. 3 is a variant embodiment of FIG. 2.

In FIG. 3*a*, the pusher magnet 35 has merely been turned over, so that its north pole is directed downwards and its south pole is directed upwards. As a result, the pusher 3 is urged magnetically downwards so that the studs 33 come to bear, or into abutment, against the low abutments 43 of the guide grooves 42. In this low position, the pusher penetrates further into the cylinder 46 than in the embodiment in FIG. 2.

Figure 4:
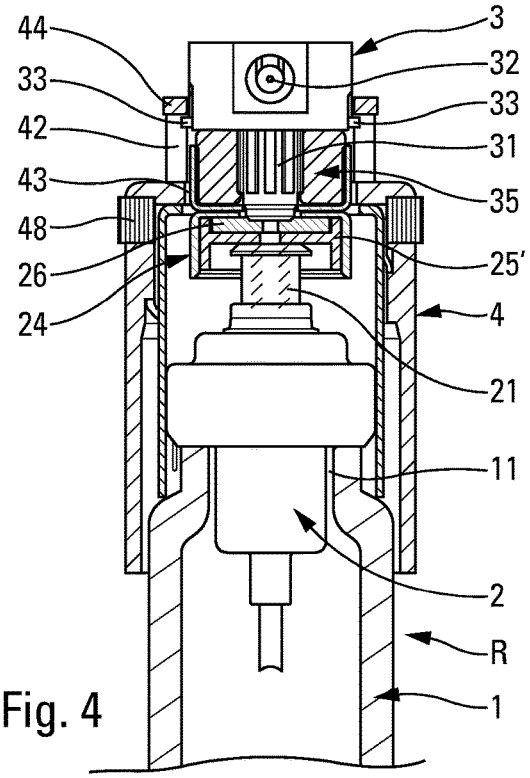
FIGS. 4 and 5 show a fluid dispenser of the invention using a refill constituted by a reservoir and by a dispenser member, and an assembly in accordance with FIGS. 1 and 2, respectively in its connected position (FIG. 4) and in its disconnected position (FIG. 5)
Figure 5:
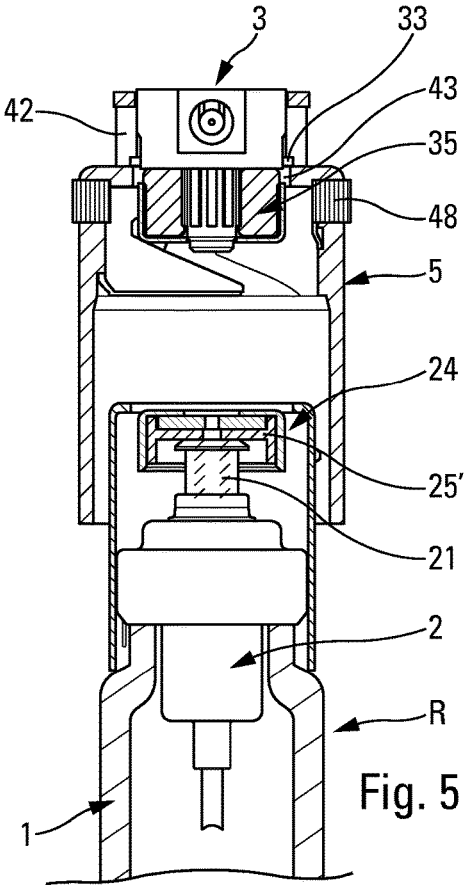

Reference is made below to FIGS. 4 and 5 in order to describe a fluid dispenser constituting an embodiment of the invention. The second assembly constituted by the covering shell 4 and the pusher 3 is the variant embodiment assembly shown in FIG. 3, with the pusher in abutment against the low abutment 43. The first assembly R formed by the reservoir 1 and by the dispenser member 2 is in place inside the shell 4 in FIG. 4. The fluid reservoir 1 includes an opening 11 in which a dispenser member, such as a pump or a valve, is mounted in stationary and leaktight manner. The dispenser member 2 includes an actuator rod 21 that is axially movable down and up. The actuator rod 21 is provided with a ring 24 that has the function of providing a leaktight connection between the actuator rod 21 and the connection sleeve 31 of the pusher 3. To this end, the ring 24 may include a sealing gasket 26 for coming into direct or indirect contact with the connection sleeve 31. Optionally, the ring 24 may incorporate a ferromagnetic element 25' that is to be magnetically attracted by the pusher magnet 35. A magnetic connection is thus made between the actuator rod 21 and the connection sleeve 31. In FIG. 4, it should be observed that the distance separating the electromagnetic element 25' from the pusher magnet 35 is shorter than the distance separating the two magnets 35 and 48. Thus, the magnetic attraction force exerted between the ferromagnetic element 25' and the pusher magnet 35 is greater than the magnetic attraction force exerted between the two magnets 35 and 48. When the first assembly R is in its operational position inside the covering shell 4 as shown in FIG. 4, the user can press on the pusher 3 so as to move it inside the holding collar 41 and drive the actuator rod 21 into the body of the dispenser member 2. In response, fluid in optionally-metered form is dispensed through the dispenser orifice 32 of the pusher 3, in entirely conventional manner. While moving axially downwards, the pusher 3 starts from a position in which its studs 33 are in abutment against the high abutments 44, in order to reach a depressed position in which the studs 33 come into contact as much as possible with the low abutments 43.

When the user removes the first assembly R from the covering shell 4, as shown in FIG. 5, the pusher 3 is initially entrained by the magnetic force exerted between the ferromagnetic element 25' and the pusher magnet 35 until the studs 33 come into abutment against the low abutments 43. Then, the ring 24 is separated from the pusher magnet 35, leaving the pusher 3 in its low position. This position is held by the magnetic force exerted between the shell magnets 48 and the pusher element 35, as explained above with reference to FIG. 3.

It should be clearly understood that the magnetic forces exerted between the ferromagnetic element 25' and the pusher magnet 35 are greater than the magnetic forces exerted between the pusher magnet 35 and the two shell magnets 48, so as to avoid disturbing the operation of the dispenser. However, the magnetic forces exerted between the magnets 35 and 48 still exist, and advantageously participate in reducing the force needed to depress the pusher 3. The presence of the shell magnets 48 may also serve to reinforce the connection between the ring 24 and the pusher magnet 35.

Figure 6:
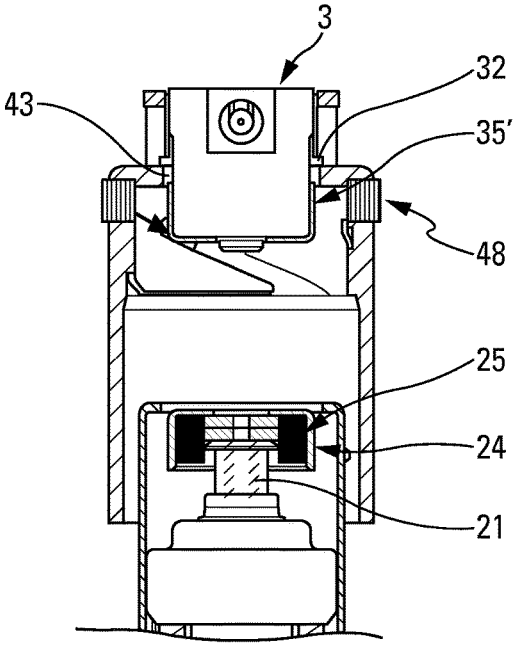
FIG. 6 shows a variant embodiment of FIG. 5.

FIG. 6 shows a variant embodiment in which the ring 24 that is mounted on the actuator rod 21 supports a magnet 25, and not just a ferromagnetic element 25'. In symmetrical manner, the pusher 3 is provided with a ferromagnetic element 35', replacing the pusher magnet 35 as used above. The ferromagnetic element 35' no longer presents magnetic poles, and just by being positioned level with the shell magnets 48 it makes it possible to hold the pusher stationary in its low position with its studs 33 in contact with the low abutments 43.

Figure 7:
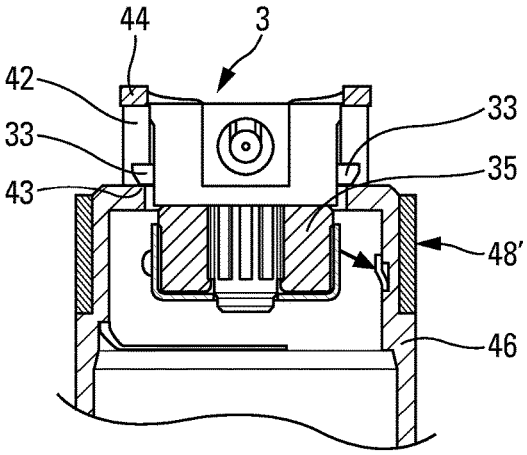
FIG. 7 shows still another variant embodiment of FIGS. 2 and 3.

FIG. 7 shows a variant embodiment in which the two shell magnets 48 are replaced by a ferromagnetic element 48' that, by way of example, may be in the form of a bushing engaged around the top portion of the cylinder 46. The pusher itself is still fitted with a pusher magnet 35. The studs 33 are thus also in abutment against the low abutments 43, as in the variant embodiment of FIG. 3.

Without going beyond the ambit of the invention, a first assembly R may very well be provided having an actuator rod 21 that does not have a magnet or a ferromagnetic element: in this configuration, a conventional mechanical connection is thus made between the actuator rod 21 and the connection sleeve 31. However, using a magnet or a ferromagnetic element at the actuator rod 21 is preferable, given that the pusher 3 is already fitted with a magnet 35 or with a ferromagnetic element 35'.

By means of the invention, the pusher that is held captive by the covering shell may be held in a determined position without using mechanical holding means, which could hinder its axial movement while dispensing fluid.

The invention claimed is:

1. A fluid dispenser comprising:

a fluid reservoir that defines an opening;

a dispenser member that is mounted in the opening of the reservoir and that includes an actuator rod;

a pusher for mounting on the actuator rod of the dispenser member; and a covering shell in which an assembly, formed by the reservoir and the dispenser member, is adapted to be held in removable manner, the pusher being held captive by the covering shell so that said actuator rod can be connected to the pusher only in the covering shell, the pusher being axially movable in the covering shell over a limited stroke that is defined by a low abutment and a high abutment;

magnetic means act between the covering shell and the pusher so as to hold the pusher, by magnetic attraction/repulsion, in a determined position that is stationary relative to the covering shell, when the actuator rod is disconnected from the pusher.

2. The dispenser according to claim 1, wherein the magnetic means comprise at least one shell magnet that is secured to the covering shell, and at least one pusher magnet that is secured to the pusher.

3. The dispenser according to claim 1, wherein the magnetic means comprise at least one magnet that is secured to the covering shell or to the pusher, and at least one ferromagnetic element that is secured to the pusher or to the covering shell.

4. The dispenser according to claim 1, wherein the shell includes a cylinder that surrounds the reservoir, and part of the magnetic means is mounted on the cylinder.

5. The dispenser according to claim 1, wherein the pusher includes a connection sleeve for coming into engagement with the actuator rod, the part of the magnetic means is secured to the pusher and mounted around the connection sleeve.

6. The dispenser according to claim 1, wherein the actuator rod is provided with a rod magnet or with a rod ferromagnetic element that co-operates with the magnetic means so as to make a magnetic connection between the actuator rod and the pusher.

7. The dispenser according to claim 6, wherein a magnetic attraction is stronger between the actuator rod and the pusher than between the pusher and the covering shell.

8. The dispenser according to claim 6, wherein the magnetic means hold the pusher in said determined position that corresponds to being put into abutment against the low abutment.

9. The dispenser according to claim 1, wherein the magnetic means hold the pusher in said determined position that corresponds to putting a stud that is secured to the pusher into abutment against one of the low and high abutments formed by the covering shell.

10. The dispenser according to claim 9, wherein the covering shell defines a holding collar in which the pusher is engaged and held captive while moving axially over said limited stroke.

11. The dispenser according to claim 10, wherein the holding collar defines at least one axial guide groove that is closed at both of its ends, respectively defining the low and high abutments, the pusher including at least one stud that is engaged in the axial guide groove and that is axially movable in the axial guide groove between the low and high abutments.

12. The dispenser according to claim 11, wherein the stud is formed on a flexible tab that enables the stud to be put into place in the axial guide groove by elastically deforming the flexible tab.

13. A fluid dispenser comprising:

a fluid reservoir that defines an opening;

a valve or pump that is mounted in the opening of the reservoir and that includes an actuator rod;

a pusher for mounting on the actuator rod of the a valve or pump; and a covering shell in which an assembly, formed by the reservoir and the a valve or pump, is adapted to be held in removable manner, the pusher being held captive by the covering shell so that said actuator rod can be connected to the pusher only in the covering shell, the pusher being axially movable in the covering shell over a limited stroke that is defined by a low abutment and a high abutment;

one or more magnets acting between the covering shell and the pusher so as to hold the pusher, by magnetic attraction/repulsion, in a determined position that is stationary relative to the covering shell, when the actuator rod is disconnected from the pusher.

* * * * *